US005475575A

United States Patent [19]

Chin-Hsiang

[11] Patent Number: 5,475,575

[45] Date of Patent: Dec. 12, 1995

[54] FOCUSABLE FLASHLIGHT

[76] Inventor: Chen Chin-Hsiang, No. 32 Lane 398, Fu Chiang Rd. Sec. 2, Yung Kang Hsiang, Tainan Hsiang, Taiwan

[21] Appl. No.: 180,017

[22] Filed: Jan. 11, 1994

[51] Int. Cl.[6] ..... F21L 7/00

[52] U.S. Cl. ..... 362/203; 362/202; 362/118

[58] Field of Search ..... 362/118, 205, 362/208, 202, 187, 188, 203

[56] References Cited

U.S. PATENT DOCUMENTS

| | | | |
|---|---|---|---|
| 1,397,646 | 11/1921 | Maisel | 362/205 |
| 3,963,914 | 6/1976 | Browning et al. | 362/118 |
| 4,286,311 | 8/1981 | Maglica | 362/205 |
| 4,949,231 | 8/1990 | Wang | 362/205 |
| 4,999,750 | 3/1991 | Gammache | 362/203 |
| 5,331,528 | 7/1994 | Chen | 362/205 |

*Primary Examiner*—Ira S. Lazarus
*Assistant Examiner*—Thomas M. Sember

[57] ABSTRACT

A focusable flashlight comprising a cylindrical tube for containing a battery, a head combined with the front end of the tube by means of a spring stop, a lamp holder and a spring pusher, the head functioning as a switch by being movably screwed to change the distance between the lamp holder and the front end surface of the tube in turning on or off electric power from the battery and at the same time light focusable by means of a transparent lens and a light reflector fixed at the front of the head.

2 Claims, 3 Drawing Sheets

FOCUSABLE FLASHLIGHT

BACKGROUND OF THE INVENTION

There are quite a variety of flashlights known, such as U.S. Pat. Nos. 4,286,311 "FLASHLIGHT", 4,388,673 VARIABLE LIGHT BEAM FLASHLIGHT AND RECHARGING UNIT", 4,527,223 "FLASHLIGHT", 4,577,263 "MINIATURE FLASHLIGNT", 4,951,183 "FOCUSABLE FLASHLIGHT". They are all turned on and off by a button switch, but have too many components for adjusting its focusing light and a switch base is deposited in the interior of the cylindrical tube to increase complexity of assemblage.

SUMMARY OF THE INVENTION

This invention has been devised to offer a focusable flashlight improved in the drawback mentioned above.

A focusable flashlight in the present invention comprises a cylindrical tube, a head and a tail cap combined together.

The cylindrical tube has an inner opening in a front end for a spring pusher to fit therein for pushing a rear spring forward. A metal lamp holder is provided in front of the front end of the tube for holding threadably a lamp and pushing a front spring deposited between a spring stop fitted at a rear end of the head and the lamp holder. A lamp is screwed in a center threaded hole of the lamp holder, extending in a center hole of the rear end of the head and through the lamp holder and the spring pusher. The front spring is located before the lamp holder, and the rear spring is located behind the lamp holder. When the head is threadbly rotated relative to the tube to move backward from a turn-off position, forcing the spring stop to push backward the front spring, the lamp holder and the rear spring and the rear spring,letting a rear conductive point of the lamp held in the lamp holder contact a positive pole of a battery to turn on the electric power to light up th lamp. The head is possible to be rotated to move in the turn-on position further rearward, letting a lens fixed at the front of the head move nearer the front end of the lamp for changing the distance between the both, the lens and the lamp, so as to change light focused. On the contrary, rotation of the head from the turn-on position to the turn-off position, i.e. forward can separate the conductive point of the lamp from the positive pole of the battery to turn off electric power from the battery.

In short, rotation of the head functions as a switch of the focusable flashlight of the present invention.

The tail cap is provided with a rear threaded end for screw with a pen clamp, and a pen tip is fitted in a hole in the rear threaded end so that the pen tip can be used for writing by removing the pen clamp from the tail cap.

DETAILED DESCRIPTION OF THE INVENTION

Figure 1:
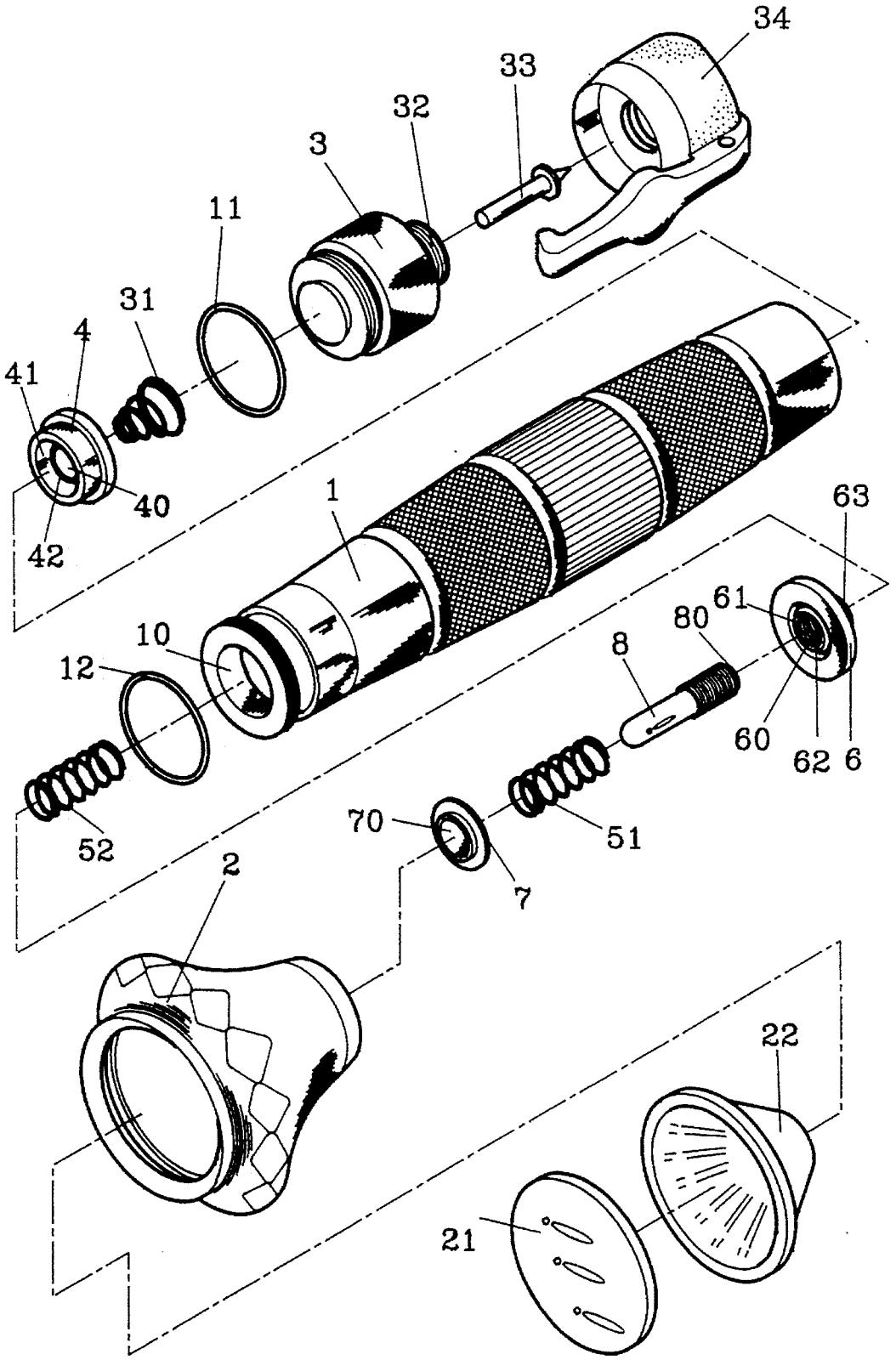
FIG. 1 is an exploded perspective view of a focusable flashlight in the present invention.
Figure 2:
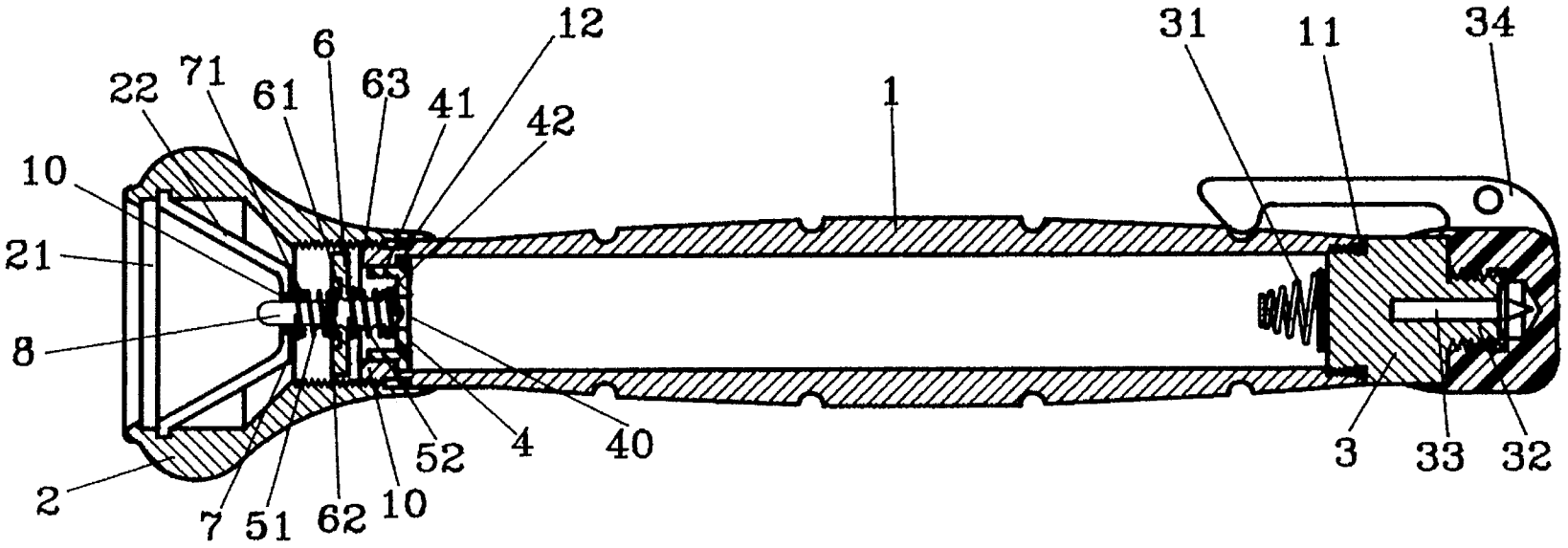
FIG. 2 is a cross-sectional view of the focusable flashlight in the present invention.

A flashlight in the present invention, as shown in FIG. 1, comprises a cylindrical tube 1, a head 2 and a tail cap 3 respectively combined with a front end and a rear end thereof. The cylindrical tube 1 can be made in different lengths to receive a selected number of batteries.

The cylindrical tube 1 has a male threaded front end for a female threaded rear end of the head 2 to screw together, and a rear female threaded end for a male threaded front end of the tail cap 3 to screw with and a water-seal ring 11, or 12 is respectively fixed around the screwed connection. An opening 10 is provided in the front end of the tube 1 for receiving an annular spring pusher 4 to be fitted therein by pushing through from the rear end.

The head 2 has a female threaded rear end to screw with the front end of the tube 1 so that the head 2 may be moved nearer to or further away from the tube 1, and a water-seal ring 12 is fixed around the front end of the tube 1. A transparent lens 21 and a light reflector 22 are disposed in the front end of the head a for focusing light coming from the lamp.

The tail cap 3 has a small-diameter rear male threaded portion 32, a pen hole provided in the rear threaded portion 32 for a pen tip 33 to be deposited therein. The rear male threaded portion 32 screws with a female thread of a pen clamp 34 to be carried with the flashlight.

An annular spring pusher 4 is provided for insulation, made of plastic, formed with a center hole 40 for a lamp to extend therein, a spring opening 41 facing to the front, an annular spring hook 42 extending around the center hole 40 and to the front and having a sloped circumferential edge and an annular groove behind the sloped edge for a rear end of a rear spring 52 to slide along and hook thereon.

A front spring 51 is provided to have its rear end hooked on a front annular spring hook 62 of a lamp holder 6 and its front end hooked on a annular spring hook 71 of a spring stop 7.

A rear spring 52 is provided between the annular spring pusher 4 and a lamp holder 6, with a rear end stably hooked on the annular groove of the annular spring pusher 4 and with a front end hooked in an annular groove of a spring hook 63 of the lamp holder 6.

A lamp holder 6 is provided between a front spring 51 and the rear spring 52, located between the tube 1 and the head 2, having a center threaded hole 60 for a lamp to movably screw with, a spring hole 61 in the front side, a front annular spring hook 62 for a rear end of the front spring 61 to hook on, and a rear annular spring hook 63 for the front end of the rear spring 52 to hook on. Then the lamp base 6 may be moved forward or backward by elasticity of both springs 51, 52. And the front and the rear annular spring hook 62, 63 respectively have a sloped circumferential edge and an annular groove for a rear end of the front spring 51 and the front end of the rear spring 52 to hook thereon. A spring stop 7 is shaped to have an annular front wall to fit in a rear center hole of the light reflector 22, a center hole 70 for the head of the lamp 8 to insert through, and an annular spring hook 71 for the front end of the front spring 51 to hook thereon.

Figure 3:
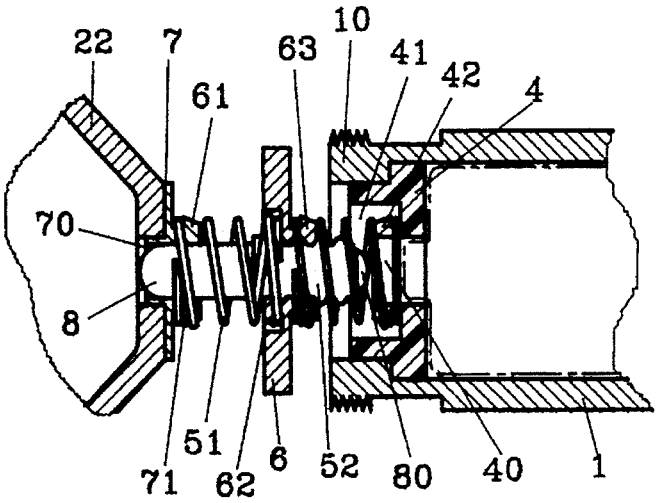
FIG. 3 is a cross-sectional view of the focusable flashlight in the present invention, showing its electric power being turned off.
Figure 4:
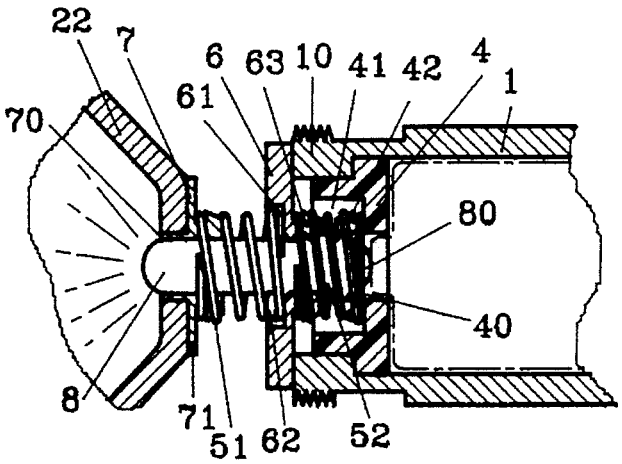
FIG. 4 is a cross-sectional view of the focusable flashlight in the present invention, showing its electric power being turned on with a larger focusing distance.
Figure 5:
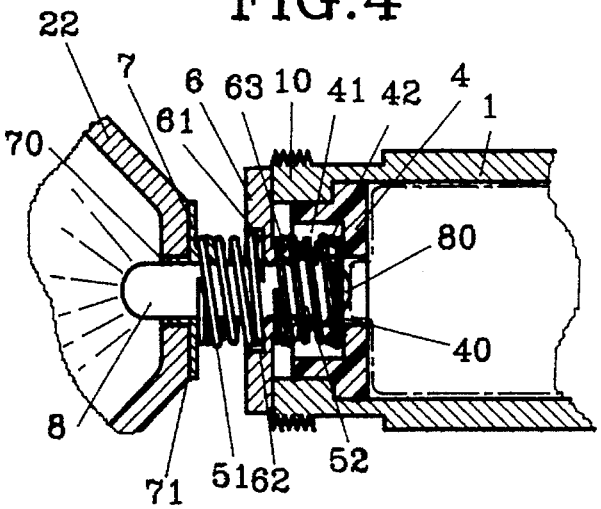
FIG. 5 is a cross-sectional view of the focusable flashlight in the present invention, showing its electric power being turned on with a short focusing distance.

All the components are made of metal, except the spring pusher 4 and the pen tip clamp 34, which are made of plastic for insulation. Therefore, the negative pole of the battery, the tail cap 3, the tube 1, the head 2, the spring stop 7 and the lamp holder 6 form a negative circuit, and the positive pole of the battery and a rear conductive point 80 of the lamp 8 form a positive circuit. As shown in FIGS. 3–5, rotation of the head 2 relative to the tube 1 makes itself and the spring stop 7 in the light reflector 22 move from a turnoff position to a turn-on position or vice versa. In the turn-off position shown in FIG. 3, the conductive point 80 of the lamp 8 is in a separated position from the positive pole of the battery, and in the turn-on position shown in FIGS. 4 and 5, the conductive point 80 of the lamp 8 is in contact with the positive pole of the battery, with the lamp holder being in contact with the front end of the tube 1. In the turn-on position, the front spring 51, the lamp holder 6, the rear spring 52 are retreated, forcing the conductive projection 80 contact the positive pole of the battery to light up the lamp 8. Further rotation of the head 2 may push further backward the spring stop 7, the front and the rear spring 51, 52, and then the distance between the lens 21 and the lamp 8 shortened to alter the light focused by retreating movement of the lens 21 together with the reflector 22.

What is claimed is:

1. A focusable flashlight comprising:

a cylindrical tube including a front end with male threads cut thereon, and an inner cavity to receive a spring pusher which is inserted through an opening in a rear end of said tube;

a flashlight head having a rear end with female threads therein, the flashlight head screwing onto said front end of said tube;

a transparent lens secured in a front end of the flashlight head to focus light from a lamp, and a light reflector secured in the front end of the flashlight head behind the transparent lens;

a tail cap to secure the rear end of said tube;

said spring pusher is made from an insulative material and has a center hole therein to receive a rear end of the lamp, the spring pusher further including an annular wall on a front end thereof, the annular wall defining a spring hole, the center hole including an annular spring hook;

a front spring positioned between a lamp holder and a spring stop, the front spring having a front end secured to an annular spring hook on the spring stop and a rear end secured to an annular front spring hook of the lamp holder;

a rear spring positioned between the spring pusher and the lamp holder, the rear spring having a front end secured to an annular rear spring hook on the spring stop and a rear end secured to the annular spring hook of the spring pusher;

said lamp holder including a threaded center hole to receive the lamp therein, a head of the lamp extending through a center hole in the spring stop and into an interior of the flashlight head; wherein the flashlight is turned on by rotating the flashlight head so that it moves rearward along said tube to an on position, thus moving a rear conductive point of the lamp into contact with a positive pole of a battery contained in said tube; and while in the on position, the distance between the lens and the lamp changes as the flashlight head is moved to alter the focus point of light emitted from the lamp; and wherein the flashlight is turned off by rotating the flashlight head so that it moves forward along said tube to an off position, thus moving the conductive point away from the positive pole of the battery.

2. The flashlight as claimed in claim 1 wherein:

each annular spring hook is shaped to have a sloped circumferential edge and an inner annular groove to receive an end of the front and rear springs, the grooves stabilizing the springs when they are positioned therein.

* * * * *